United States Patent [19]

Brandeau

[11] 4,241,498

[45] Dec. 30, 1980

[54] DEVICE AND METHOD FOR TERMINATING A FLAT CABLE

[75] Inventor: Edward P. Brandeau, Willimantic, Conn.

[73] Assignee: Akzona Incorporated, Asheville, N.C.

[21] Appl. No.: 9,562

[22] Filed: Feb. 5, 1979

[51] Int. Cl.[3] ..... H01R 43/04; H01R 11/20

[52] U.S. Cl. ..... 29/861; 29/857; 339/99 R

[58] Field of Search ..... 339/97 C, 176 MF, 99 R, 339/97 R, 97 P, 98, 99; 174/88 R, 94 R; 29/628, 857, 861, 863, 865, 866

[56] References Cited

U.S. PATENT DOCUMENTS

| | | | |
|---|---|---|---|
| 2,759,161 | 8/1956 | Berg | 339/97 C |
| 3,881,796 | 5/1975 | Saunders | 339/97 C |
| 4,082,402 | 4/1978 | Kinkaid | 339/97 C |

*Primary Examiner*—John McQuade
*Assistant Examiner*—John S. Brown
*Attorney, Agent, or Firm*—Francis W. Young; David M. Carter

[57] ABSTRACT

There is provided a device and method for terminating a flat cable having at least one elongated substantially rectangular insulated conductor by punch and die action. The device includes opposing semi-cylinderical metallic jaws which may be attached to and aligned with one another through a tab. The curved portion of each jaw is in the form of alternating grooves and lands with the grooves of one jaw adapted to receive corresponding opposing lands of the other jaw when the cable is terminated. To terminate the cable, the insulated conductor is placed between the aligned jaws and inward force is applied on the back sides of the jaws forcing the lands into the grooves. The cable insulation is pierced and adjacent portions of the conductor are elongated and sheared by the meshing of the grooves and lands, much like a punch and die process, forming embossed strips on the conductor. Fresh metallic internal edges, preferably parallel to the longitudinal direction of the conductor, are thus formed from this shearing and electrical contact is made between the sides of the grooves and these newly formed internal edges of the conductor.

17 Claims, 7 Drawing Figures

FIG. 4
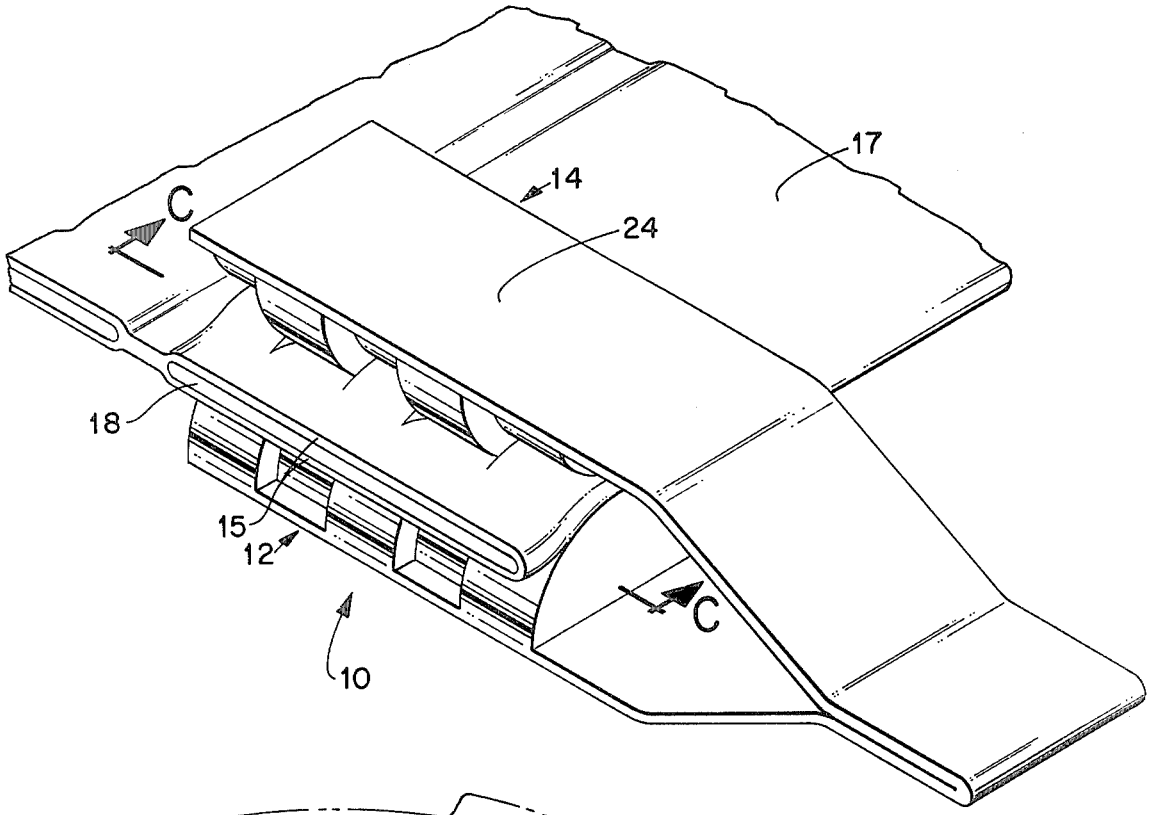
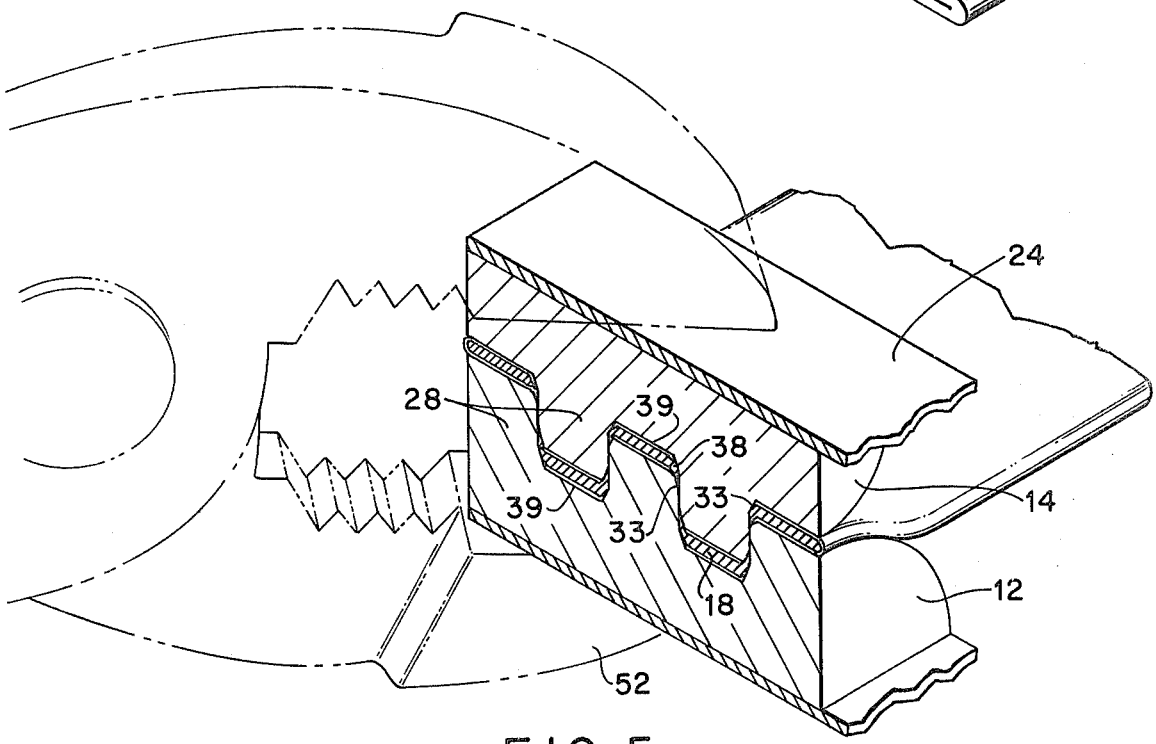
FIG. 5

DEVICE AND METHOD FOR TERMINATING A FLAT CABLE

BACKGROUND OF THE INVENTION

This invention relates to an improved device and method for terminating an insulated flat cable. More particularly, it relates to a device and method for easily and effectively terminating or tapping an insulated flat power conductor at any place along the length of the conductor.

As flat insulated electrical cable has become more and more popular in both communication and power applications, the need to provide a simple and inexpensive technique and device for terminating the cable is growing. A standard industry-wide method for terminating a flat cable has been to use a grinding machine to strip away the jacket and/or insulation at the place on the cable where termination is desired. A termination device, such as an electrical connector, is then soldered onto the bare conductor. Obviously, this procedure for termination is very time consuming and costly and is very difficult to accomplish in the field.

In order to reduce the cost of terminating flat cable, the industry has, in some instances, begun to use insulation piercing-type terminations. One connector which has been used to terminate flat power cable is the "Dragon Tooth" connector, commercially available from the Thomas and Betts Company. The "Dragon Tooth" connector utilizes a plurality of "teeth" on two sides of an integral piece of metal. The cable is placed between the teeth and the opposing sides of the connector are squeezed together with a high tonnage pressure tool causing the teeth to penetrate the insulation and further penetrate into the connector metal on the top and bottom of the conductor. However, the Thomas and Betts connector requires a hydraulic tool which is expensive and cumbersome for use in the field.

Another type of termination for flat power conductors is the "Termi-Foil" connector commercially available from AMP Inc. The "Termi-Foil" connector comprises two strips of metal each having a plurality of teeth and holes, like a cheese grater, with each tooth on one strip aligning with a hole on the other strip. A flat cable is placed between the strips and a special high force tool crimps the connector to the flat conductor. Generally, this system works only with bare flat conductor, and in the larger conductor gauges, requires a hydraulic tool. Thus it suffers from many of the drawbacks inherent in the Thomas & Betts system.

Other types of terminations have been utilized for power cable, such as those shown in U.S. Pat. Nos. 3,881,796, 3,825,881, 3,668,613, 3,259,873, and 3,201,744. However, each of these has problems similar to those set forth above. Thus, it is desirable to provide a termination for a flat electrical cable and particularly for a flat power cable which overcomes the deficiencies of the prior art as well as having other advantages.

OBJECT OF THE INVENTION

It is therefore one object of this invention to provide an improved termination system for a flat cable.

It is another object to provide a low cost and improved performance termination system for a flat power cable which uses a simplified tool.

It is another object to provide a device for electrically tapping an insulated flat cable at any point along the length of the cable, and without removing any of the insulation.

It is another object to provide a termination system for a flat cable which has improved electrical and mechanical characteristics.

SUMMARY OF THE INVENTION

In accordance with one form of this invention, there are provided a device and a method for terminating flat cable having at least one substantially flat rectangular conductor. The device includes opposing semi-cylindrical metallic jaws. The curved portion of each jaw is in the form of alternating grooves and lands with the grooves of one jaw adapted to receive the corresponding opposing lands of the other jaw. The flat conductor is placed between the aligned jaws and is terminated by the application of inward force on the back sides of the jaws forcing the lands into the grooves. The cable insulation is sliced and adjacent portions of the conductor are elongated and sheared in one direction by the meshing of the grooves and lands, much like a punch and die process, forming embossed strips on the conductor. Fresh metallic internal edges, preferably parallel to the longitudinal direction of the conductor, are thus formed in the conductor and electrical contact is made between the sides of the grooves and these newly formed, clean internal edges of the conductor. This termination will normally remain mechanically clamped to the cable without the need for auxilliary clamping devices.

BRIEF DESCRIPTION OF THE DRAWINGS

The subject matter which is regarded as the invention will be set forth in the appended claims. The invention itself, together with other objects and advantages thereof, will be apparent from the following description taken in conjunction with the accompanying drawings in which:

FIG. 4 is a partial pictorial view of the device and cable shown in FIG. 1 with the device terminated to one of the conductors of the cable.

FIG. 5 is a combination partial pictorial and cross-sectional view of the device and cable shown in FIG. 4, the section taken through line C—C of FIG. 4;

DESCRIPTION OF THE PREFERRED EMBODIMENT

Figure 1:
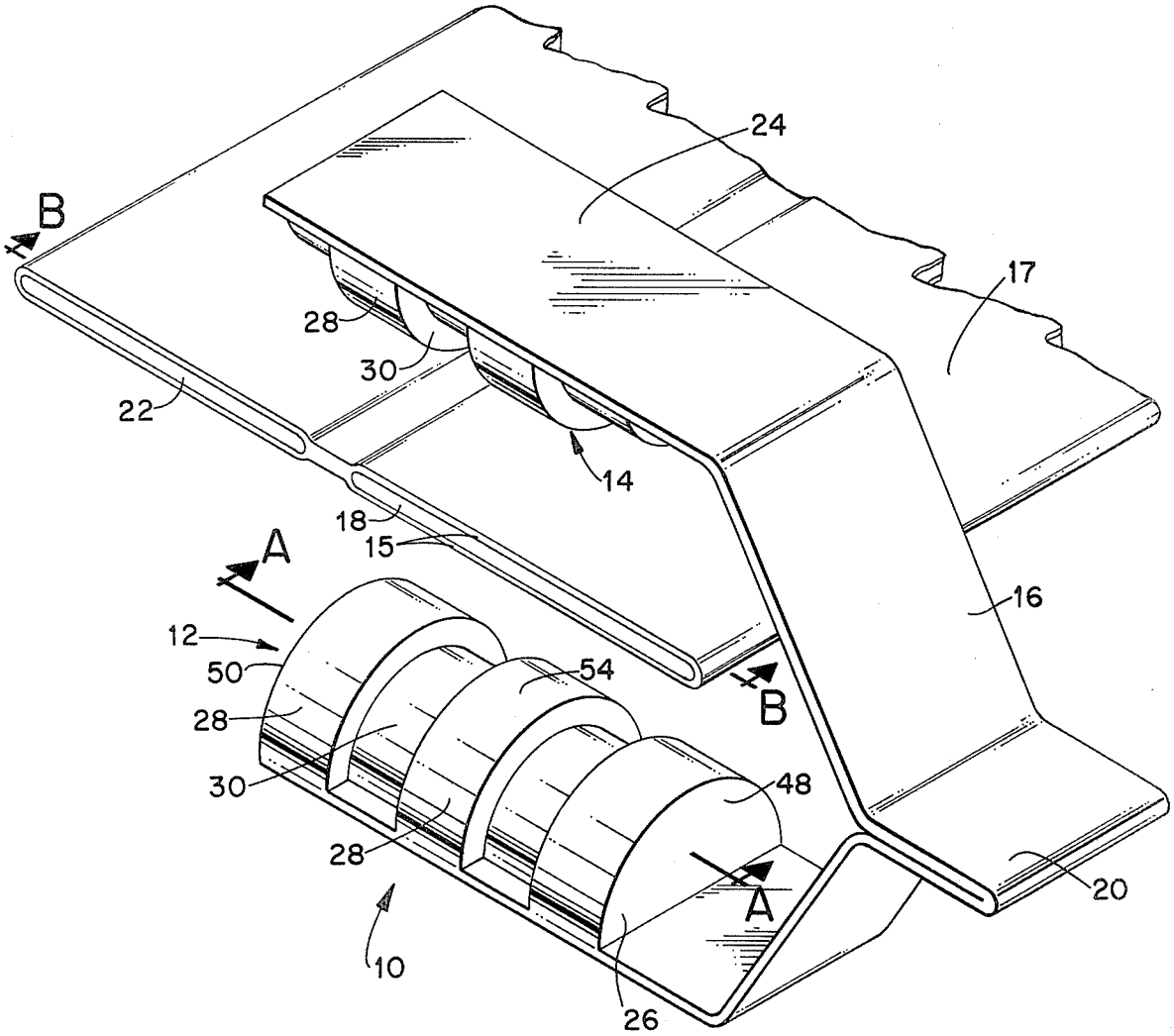
FIG. 1 is a partial pictorial view of a flat cable situated between the jaws of the termination device in the open position incorporating some of the features of the subject invention.

Referring now more particularly to FIG. 1, there is provided electrical termination device 10 having jaws 12 and 14 which in this embodiment are attached to one another through metallic strip 16. Tab 20, which is a part of strip 16 may be connected to a power inlet or to another cable.

Figure 2:
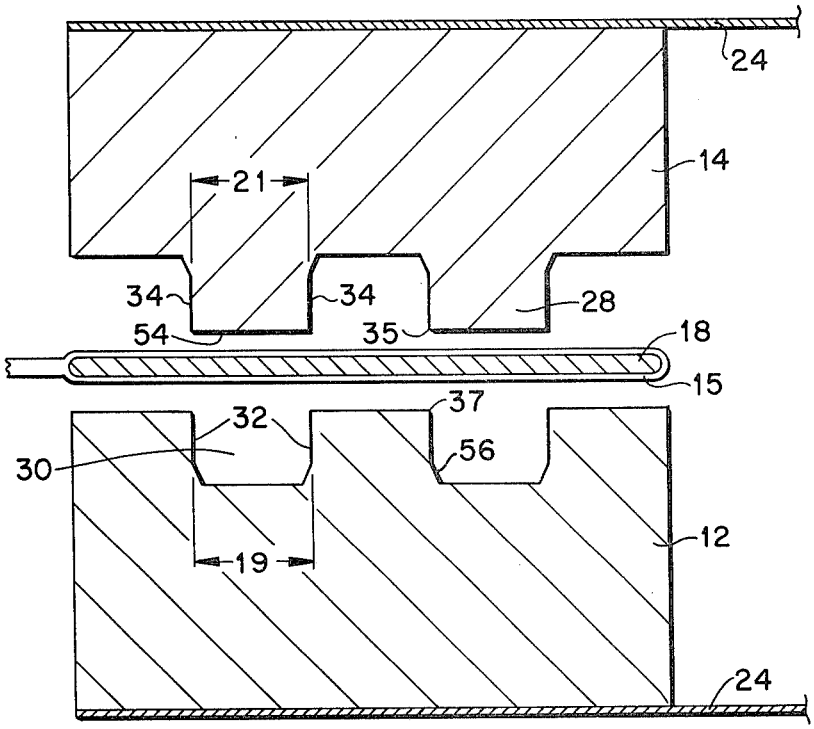
FIG. 2 is a partial cross-sectional view of the device shown in FIG. 1 taken through line A—A.

The jaws 12 and 14 are made of a hard, electrically conductive metal, such as brass, and are easily formed by a lathe. The jaws are substantially identical in shape and size and as seen in FIG. 2, each includes a flat plate back portion 24 and a solid semi-cylinderinal portion 26. The semi-cylinderinal portion is in the form of alternating lands 28 and grooves 30. The lands of one jaw are aligned with and, together with a portion of the cable, adapted to be tightly received in a corresponding oppositely facing groove in the other jaw.

Metallic conductor 18 of electrical power cable 17 is placed between the jaws when the conductor is to be terminated. The parallel conductor 22 of cable 17 may also be terminated at any point along its length of another termination device (not shown) such as device 10.

Strip 16 maintains the jaws and thus the opposing grooves and lands in proper alignment. The alignment of the grooves and lands may be better seen in reference to FIG. 2, which shows a cross-section of a portion of the jaws and the cable shown in FIG. 1 taken through lines A—A.

As can be seen, the grooves and lands of jaw 12 are directly under opposing lands and grooves of jaw 14 in a complimentary fashion. It should be noted that in terminating the cable each land performs like a punch and each groove performs like a die while the cable is the work piece, similar to a punch and die manufacturing process. As shown in FIG. 5, ordinary hand held pliers 52 may be used to provide the force to close the jaws about the cable and thus terminates the cable. Referring again to FIG. 2, in one embodiment, the width 19 of the top portion of each groove 30 is slightly greater than width 21 of it corresponding oppositely facing land 28, i.e. slightly less than an interference fit. The width 21 of each land is 0.100 inch and the width 19 of the top portion of each groove is 0.102 inch. When the jaws are closed down onto the cable, the lands are moved into the grooves and the insulation and conductor 18 are progressively sheared in the longitudinal direction of the cable. This shearing is due to the close fit between walls 33 of the grooves and walls 34 of the lands and the progressive cutting or scissors effect caused by the curvature of the grooves and lands. Thus, the corresponding sharp edges 35 and 37 of each land and groove act as a scissors in cutting through the insulation 15 and conductor 18. This in turn means that the force needed to mate connector parts 12 and 14 is relatively low.

FIG. 4 shows the termination device and cable of FIG. 1 subsequent to the jaws of the termination device being clamped about and through the insulation and conductor of the power cable. The device 10 terminates conductor 16 without the need for high tonnage pressure tools as is required in prior art termination devices. As stated previously, an ordinary pair of pliers which is available from most any hardware store, will suffice. The jaws of the pliers engage the flat back portion 24 of each of the jaws of the termination device. The insulation 15, which may be a tough fluorocarbon such as "Tefzel" sold by E. I. DuPont Nemours Company, and the metallic conductor 18, which may be made of copper, aluminum or other conducting metals, is easily pierced by the shear forces generated by the sharp edges of the grooves and lands by mere hand pressure on the pliers. Since the lands are so closely fitted into the grooves, the termination device tends to remain permanently clamped about the cable 17 without the need for additional clamping devices, although clamping screws (not shown) may be used to insure the security of the termination.

Figure 7:
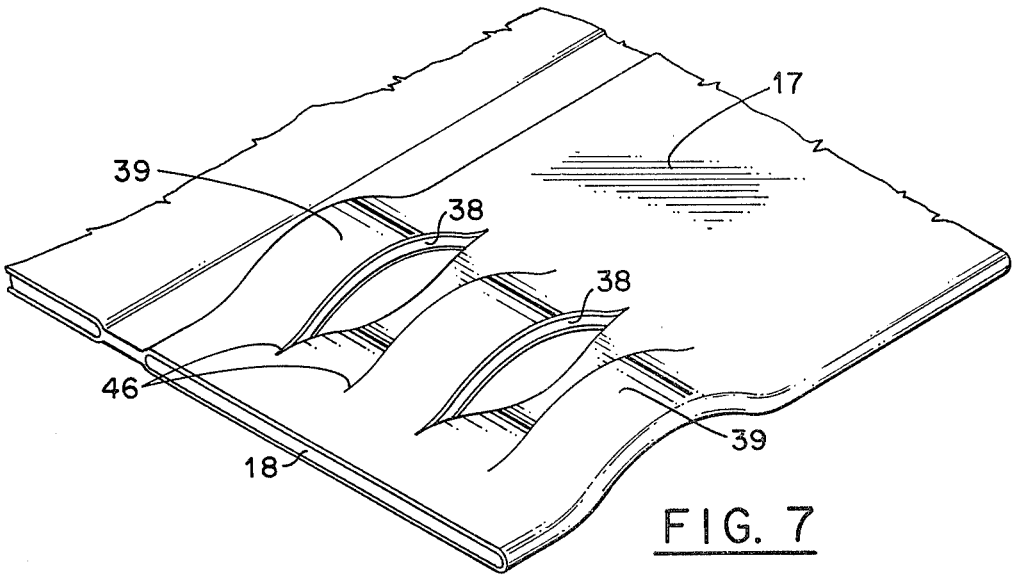
FIG. 7 is a partial pictorial view of the cable of FIG. 4 showing the cable after the termination device has been removed.

The electrical contact between the conductor and the terminating device may be better understood in reference to FIG. 5, which shows a cross-section of the termination shown in FIG. 4 taken along line C—C. As can be seen, the conductor 18, in this embodiment, is shown to be sheared in a number of places creating fresh, clean and bare metal termination contact areas where this shearing took place. Thus inside edges 38 are formed for a short distance along the length of the conductor. As seen in FIG. 7, the conductor is slightly bent up or down and thus lengthened somewhat thereby forming embossed strips 39 due to the movement of the lands into the grooves during termination. The cross-sectional area of the conductor is not decreased enough to substantially impede current flow through the conductor. Again, as seen in FIG. 7, the shearing of the conductor is in the longitudinal or current carrying direction, so that the shearing also has substantially no effect on the current carrying capacity of the conductor. Referring again to FIG. 5, it is there seen that a high force electrical termination is provided between the freshly cleaned inner longitudinal edges 38 of embossed strips 39 and the side walls 33 of the grooves. By utilizing the termination device of the subject invention, there is provided more surface area of electrical contact using the inside edges 38 of the conductor than the cross-sectional area of the end of conductor, shown in FIG. 3.

The device set forth herein is particularly useful to terminate flat conductor power cable where the ratio of the thickness of the conductor to the width 19 of the top portion of groove 30 is in the range from 1:5 to 1:1. The conductor should be thin enough to permit the jaws of the terminating device to penetrate and shear the conductor without the need for high tonnage tools, but thick enough so that the conductor does not buckle during the shearing process.

Figure 3:
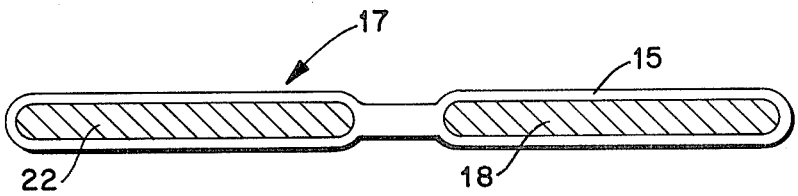
FIG. 3 is a cross-sectional view of the flat cable shown in FIG. 1 taken through line B—B.

The cable shown in FIG. 3 is a two-conductor cable, however, the termination device may be utilized with single-conductor cable or multiple-conductor cable.

Figure 6:
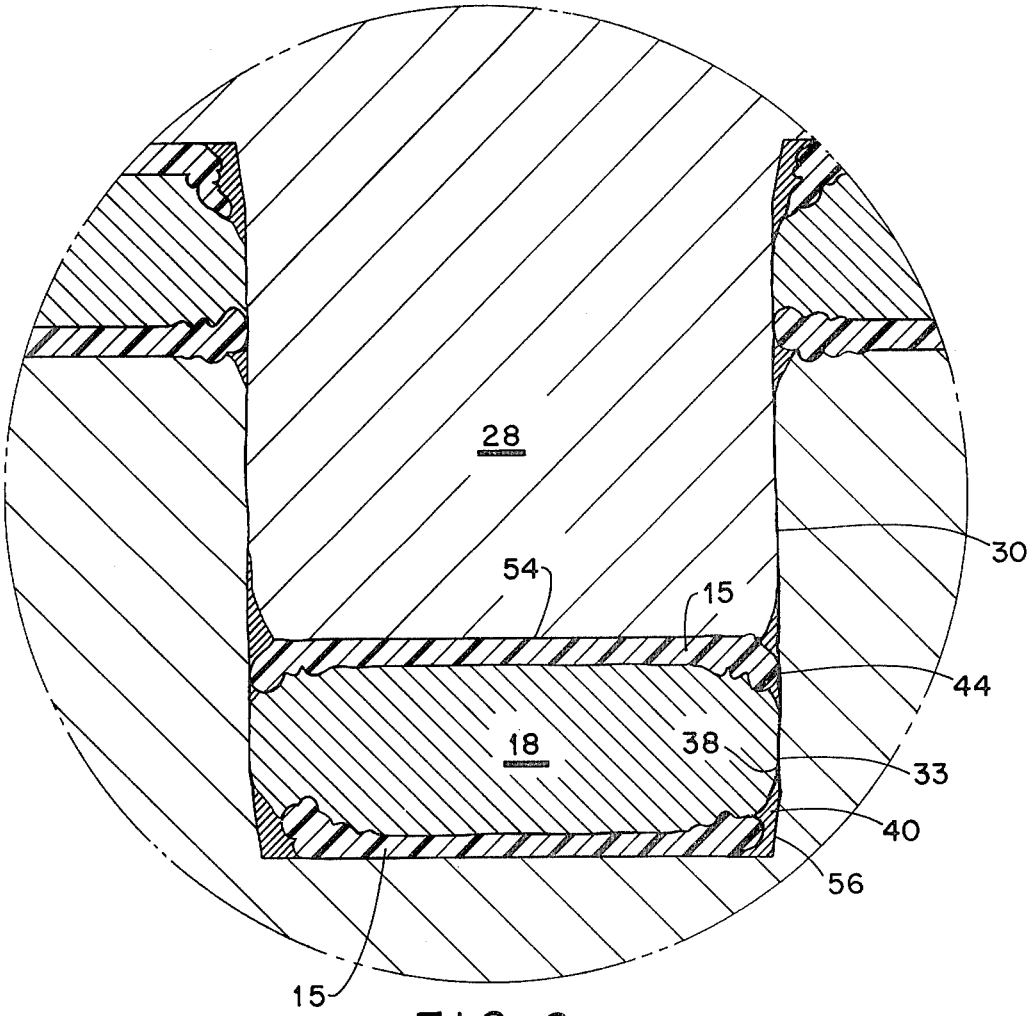
FIG. 6 is an enlarged cross-sectional view of a portion of the device and cable shown in FIG. 5.

FIG. 6 shows a magnified portion of the termination shown in FIG. 5. The device 10 may be plated with a standard tin solder alloy prior to termination. After termination, it has been found that it is advantageous to heat the terminating device to a point where the solder coating reflows. FIG. 6 shows the termination subsequent to such reflow. Solder layer 40 lies between wall 33 of groove 30 and the newly formed edge 38 of conductor 18. Thus, a solder point is provided to add to the reliability of the termination. It has been found that during heating the plastic insulation 15 contracts a bit thus opening passages, such as passage 44, permitting the solder 40 to flow or wick into cracks and crevices creating the more reliable joint both in a mechanical and an electrical sense.

As stated previously, the termination is a substantially permanent one. However, if a removal tool such as a screwdriver is forced between jaws 12 and 14, the device, upon proper manipulation of the tool, may be removed from the cable. FIG. 7 shows the cable 17 having once been terminated by device 10; however, with the terminating device removed. As can be seen, the cable has been alternately embossed in its longitudinal direction at five places forming the longitudinal sheared slits 46. As can be seen, newly formed copper edges 38 have been exposed due to the shearing of the conductor.

A flat power cable 17 has been terminated by device 10 using the following procedure. Cable 17 is placed between the first jaw 12 and the second jaw 14 of terminating device 10. Conductor 18 is centered between ends 48 and 50 of first jaw 12 at the place on the cable where the termination is desired. A pair of standard pliers 52 is opened with the opposing jaws placed on the top surfaces 24 of the oppositely facing jaws of the terminating device. The jaws of the pliers are closed by squeezing the handles of the pliers by hand thus causing the jaws to clamp down upon the cable. The insulation material 15 is easily cut through by shearing forces created by the curved sharp edges and walls of the grooves and lands. The conductor is also easily slit and sheared by these curved edges. The conductor is stretched and extruded by the force created by the tops 54 of lands 28 forming embossed strips 39. The newly formed inside edges 38 of the conductor are forced into high pressure contact with the side walls 33 of grooves 30 making electrical contact therewith. The termination then may be heated causing the insulation 42 to to contract and the tin solder to reflow into the cracks and crevices of the termination providing an even more substantial electrical and mechanical contact between the termination device and the conductor.

Another feature of the invention, which may be seen in reference to FIGS. 2 and 6, is the inwardly tapered shoulder 56 at the bottom of the grooves. This causes the conductor 18 to wedge into the bottom and thus seat in the grooves. It further provides a stop for the lands.

In testing the above termination, high current was permitted to travel through a three foot length of twelve gauge copper conductor which was terminated by the above termination. When the current reached 300 amps through the termination, the conductor 18 almost melted, however, the termination remained intact. Thus one can see that this termination provides a superior electrical power path, even superior to the conductor itself.

A power cable having two substantially rectangular cross-sectioned elongated copper conductors with 0.004 inch thick Tefzel polymer as an insulation has been terminated with the above described terminating device. The cross-sectional dimension of the copper conductors was 1 inch wide and 0.020 inch thick. The terminating device was made of solid brass, having a 0.00015 inch thickness tin solder coating. One jaw had three lands and two grooves while the other jaw had two lands and three grooves. The width of each land was 0.100 inch and the width of each groove was 0.102 inch across the top and 0.090 inch across the bottom. The device was terminated to this cable utilizing standard hardware store type pliers using normal hand pressure.

Thus it may be seen that there is provided a device which may be used to easily and reliably terminate a cable, such as a power cable, at any point along the length of the cable. Furthermore, the device may be used as a tap or as a conventional electrical connector.

From the foregoing description of the preferred embodiment of the invention, it will be apparent that many modifications may be made therein. It will be understood, however, that this embodiment of the invention is intended as an exemplification of the invention only and that the invention is not limited thereto. It is to be understood, therefore, that it is intended in the appended claims to cover all such modifications as fall within the true spirit and scope of the invention.

I claim:

1. A device for terminating flat cable having at least one substantially rectangular insulated elongated conductor, said device comprising: a first member having at least one land projecting therefrom; a second member having at least one groove therein for receiving said land, said groove having a pair of side walls; said land and said groove each having at least one sharp edge; the conductor adapted to be placed between said land and said groove whereby upon the application of a force moving said members toward one another and said land into said groove, said sharp edges of said land and said groove completely shearing through portions of the conductor and forming inner conductor edges for providing electrical contact between at least one of the formed inner edges of the conductor and at least one wall of said groove.

2. A device as set forth in claim 1 wherein said first and said second members are semi-cylinderially shaped.

3. A device as set forth in claim 2 further including a plurality of alternating grooves and lands on each of said members; said alternating lands and grooves being substantially aligned with each other.

4. A device as set forth in claim 3 further including a tab attached to said first and second member for providing alignment of said opposing land and groove and further for providing a means for making electrical connections to said device.

5. A device as set forth in claim 1 wherein said land and said groove are adapted to be longitudinally aligned with the longest dimension of the conductor whereby the cross-sectioned area of the conductor is not substantially decreased by the termination.

6. A device as set forth in claim 1 wherein said first and second members are coated with solder whereby upon heating said members to a predetermined temperature subsequent to termination said solder flows and provides solder contact between said conductor edges and the wall of said groove.

7. A device as set forth in claim 6 wherein said conductor is insulated with a polymer having a characteristic of slightly shrinking when exposed to said predetermined temperature thereby permitting said solder to flow into the termination and providing a substantially gas-tight and waterproof seal.

8. A device as set forth in claim 1 further including an inwardly tapered portion of each of said side walls of the said groove; said tapered portions substantially narrowing the width of the bottom of said groove relative to the width of the top.

9. A device for terminating a cable having at least one substantially flat conductor comprising: first and second electrically conductive members each having a curved surface; each of said curved surfaces having a plurality of alternating grooves and lands therein; said lands of one member adapted to be aligned with and received in corresponding grooves of the other member; each groove having two side walls; each of said grooves having at least one sharp edge formed, at least in part, by one of its side walls; the conductor adapted to be placed between said first and second members, whereby upon the application of force moving said lands into said grooves, the conductor is completely sheared through along its longitudinal axis by a punch and die effect of corresponding lands and grooves creating a plurality of newly formed longitudinal conductor edges; the newly formed edges being in electrical contact with said side walls of said grooves.

10. A device as set forth in claim 9 wherein said grooves and lands are convexed in shape.

11. A method for terminating a substantially flat cable having at least one substantially rectangular cross-section conductor, with a terminating device having a pair of jaws each having at least one sharp edged convexed land and at least one sharp edged groove comprising the steps of: placing a metallic conductor of said flat cable between said jaws, the longitudinal direction of said cable being approximately tangent to the convexed surfaces of said groove and land; applying substantially equal and opposite forces to said jaws in an inward direction, said land coming in contact with the surface of said conductor forcing a portion of said conductor into said groove and simultaneously completely shearing through the said conductor and oppositely bending said portion of said conductor as said portion moves into said groove; forming inner longitudinal edges on said conductor thereby providing a fresh metal contact place for an electrical termination.

12. A method as set forth in claim 11 further including the step of coating said jaws with solder prior to termination and heating said jaws subsequent to termination to the reflow temperature of said solder for providing a soldered joint at the termination.

13. A device for terminating a substantially flat electrical conductor comprising: first and second electrically conductive members; each member including a curved portion; said curved portion of each member facing each other as semi-cylindrical forms; each member having a plurality of alternating curved grooves and lands in said curved portion; each groove and land having side walls forming sharp cutting edges; said lands of one member being aligned with a corresponding groove in the other member; said first and second member being attached to one another for maintaining said alignment; said lands and grooves adapted to completely shear through the flat cable conductor forming inner conductive edges for an electrical termination.

14. A device as set forth in claim 13 wherein the width of a land of one member is substantially equal to the width of a corresponding groove oppositely facing groove of the other member.

15. An electrical joint comprising: first and second jaws; each jaw including a plurality of alternating convexed grooves and lands; said lands of one jaw received in said grooves of the other jaw; at least one of said grooves having a pair of side walls; said walls, in part, forming sharp cutting edges; embossed portions of an electrical conductor in each groove under a corresponding land; at least one of said embossed portions of said conductor having a pair of completely sheared through side edges; said edges being in substantially gas tight electrical contact with the walls of said at least one groove.

16. An electrical joint as set forth in claim 15 wherein each of said grooves further includes a bottom; the lower portion of said groove walls being tapered inwardly to said bottom.

17. An electrical joint as set forth in claim 15 wherein the ratio of the width across the top of each of said grooves to the thickness of an embossed portion of said conductor is in the range of from 1:1 to 5:1.

* * * * *